US010024200B2

(12) United States Patent
Di Nunno et al.

(10) Patent No.: US 10,024,200 B2
(45) Date of Patent: Jul. 17, 2018

(54) ROLLER TAPPET FOR A FUEL UNIT PUMP OF AN INTERNAL COMBUSTION ENGINE

(71) Applicant: GM GLOBAL TECHNOLOGY OPERATIONS LLC, Detroit, MI (US)

(72) Inventors: Davide Di Nunno, Turin (IT); Mirco De Marco, Grugliasco (IT); Luca Trabucchi, Turin (IT); Pierfrancesco De Giovanni, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 88 days.

(21) Appl. No.: 15/295,430

(22) Filed: Oct. 17, 2016

(65) Prior Publication Data

US 2017/0107863 A1 Apr. 20, 2017

(30) Foreign Application Priority Data

Oct. 16, 2015 (GB) ..... 1518341.1

(51) Int. Cl.
*F01L 1/14* (2006.01)
*F01L 1/02* (2006.01)
(Continued)

(52) U.S. Cl.
CPC ..... *F01L 1/14* (2013.01); *F01L 1/02* (2013.01); *F02M 59/102* (2013.01); *F04B 1/04* (2013.01);
(Continued)

(58) Field of Classification Search
CPC ..... F01L 1/14; F01L 1/143; F01L 1/46; F01L 2105/02; F01L 2107/00
(Continued)

(56) References Cited

U.S. PATENT DOCUMENTS 2,749,890 A * 6/1956 Oldberg ..... F01L 1/14 123/90.48
2,756,733 A * 7/1956 Meile ..... F01L 1/14 123/90.48
(Continued)

FOREIGN PATENT DOCUMENTS

DE 102009028394 A1 2/2011
EP 2910769 A1 8/2015
(Continued)

OTHER PUBLICATIONS

Great Britain Patent Office, Great Britain Search Report for Great Britain Application No. 1518341.1, dated Apr. 11, 2016.

*Primary Examiner* — Jorge Leon, Jr.
(74) *Attorney, Agent, or Firm* — Lorenz & Kopf, LLP

(57) ABSTRACT

A roller tappet for a fuel unit pump of an internal combustion engine is provided with a roller tappet bore for inserting the roller tappet within the internal combustion engine. The roller tappet includes a roller tappet body having a body longitudinal axis for connecting the roller tappet to a reciprocating element of the fuel unit pump. A cam roller contacts a cam lobe of a rotatable shaft of the internal combustion engine. The cam roller is rotatably mounted to the roller tappet body around a cam roller rotation axis. The external surface of the roller tappet body is configured to allow tilting of the roller tappet within the roller tappet bore for aligning the roller tappet with respect to the cam lobe of the rotatable shaft.

14 Claims, 6 Drawing Sheets

(51) Int. Cl.
*F02M 59/10* (2006.01)
*F04B 1/04* (2006.01)
*F01L 1/46* (2006.01)

(52) U.S. Cl.
CPC ..... *F01L 1/46* (2013.01); *F01L 2105/00* (2013.01); *F01L 2105/02* (2013.01); *F01L 2107/00* (2013.01); *F02M 2200/02* (2013.01)

(58) Field of Classification Search
USPC ..... 123/90.48, 90.5
See application file for complete search history.

(56) References Cited

U.S. PATENT DOCUMENTS 2,782,518 A * 2/1957 Tieman ..... F01L 1/14 33/611
3,303,833 A * 2/1967 Melling ..... F01L 1/14 123/90.48
4,850,311 A * 7/1989 Sohn ..... F01L 1/143 123/90.18
5,570,665 A * 11/1996 Regueiro ..... F01L 1/143 123/90.27
7,661,413 B2 * 2/2010 Sato ..... F02M 59/102 123/495
2002/0153210 A1 * 10/2002 Kurita ..... C25D 3/565 188/200
2006/0048755 A1 * 3/2006 Kamiyama ..... F02M 39/02 123/508
2006/0110273 A1 * 5/2006 Shaull ..... F02M 59/102 417/470
2006/0219198 A1 * 10/2006 Haefner ..... F01L 1/14 123/90.27
2013/0133621 A1 * 5/2013 Jones ..... F02M 59/102 123/456
2015/0233332 A1 8/2015 Hashida et al.
2015/0275834 A1 * 10/2015 Crofts ..... F02M 59/102 92/129

FOREIGN PATENT DOCUMENTS

GB 766228 A 1/1957
WO 2011072913 A2 6/2011

* cited by examiner

ROLLER TAPPET FOR A FUEL UNIT PUMP OF AN INTERNAL COMBUSTION ENGINE

CROSS-REFERENCE TO RELATED APPLICATION

This application claims priority to Great Britain Patent Application No. 1518341.1, filed Oct. 16, 2015, which is incorporated herein by reference in its entirety.

TECHNICAL FIELD

The present disclosure pertains to the fuel injection of an internal combustion engine, and in particular to a roller tappet for a fuel unit pump of an internal combustion engine.

BACKGROUND

According to a configuration of the internal combustion engine injection system, a fuel unit pump is provided in order to supply fuel under pressure to the fuel injectors (injector nozzle). The fuel unit pump is actuated by a corresponding cam lobe of a rotating shaft of the internal combustion engine, for example the camshaft or crankshaft. More in detail, the fuel unit pump is provided with a roller tappet that is contacted by the camshaft, in a cam—cam follower configuration. In particular, the cam lobe of the camshaft acts as the cam and the roller tappet acts as the cam follower. The roller tappet is connected to a reciprocating element of the fuel unit pump, so that the rotary movement of the camshaft can be transmitted to the fuel unit pump, and in particular to a reciprocating element of the fuel unit pump actuated by the contact of the roller tappet with the cam lobe of the camshaft.

In fact, the roller tappet is provided with a cam roller having a rotation axis arranged perpendicularly to the longitudinal movement direction of the above mentioned reciprocating element. The cam roller is contacted by the cam lobe(s) of the camshaft, so that the rotary movement of the camshaft can be transformed in a linear movement of the roller tappet and thus of the reciprocating element of the fuel unit pump, connected thereto. The fuel unit pump is fluidly connected to the fuel injectors, preferably by means of a fuel rail, to supply fuel in the engine cylinder.

However, a very high precision is required to assure that, when the fuel unit pump is mounted in the internal combustion engine (preferably in the cylinder head or in the engine block of the internal combustion engine), the roller tappet, and in particular the cam roller of the roller tappet, is correctly aligned with respect to the camshaft. In other words, it should be assured that the axis of rotation of the cam roller is exactly parallel to the rotation axis of the rotatable shaft, e.g. the rotation axis of the camshaft. As a result, the lateral surface of the cam roller can properly contact the lateral surface of the relevant cam lobe of the camshaft.

However, due to certain circumstances, e.g. machining errors and tolerances, it is difficult to satisfy the above mentioned conditions, so that misalignments can occur between the cam lobe and the cam roller. In order to avoid a configurations where the contact between the two elements is only punctual (the so called "edge effect"), the cam roller has a so called "crowning" or "logarithmic" profile. These profiles avoid punctual contact but, on the other side, limit the maximum possible contact area between the two elements. As a result, higher stresses are generated on the cam roller, and the cam roller is generally dimensioned larger than required. As a result, cam rollers can be complex and costly.

Moreover, the size of the cam roller cannot be increased at pleasure, so that a limit is imposed also to the fuel pressure handled by the fuel unit pump. Furthermore, because of the problem caused by misalignments, machining tolerance of the fuel unit pump and of the portions of the internal combustion engine cooperating with the fuel unit pump should be very strict.

SUMMARY

The present disclosure addresses the above mentioned problems and avoids punctual contact between the cam roller and the cam lobe of the rotatable shaft in a simple and cost effective manner. According to an embodiment of the present disclosure, a roller tappet for a fuel unit pump of an internal combustion engine is provided with a roller tappet bore for inserting the roller tappet within the internal combustion engine. A roller tappet body having a body longitudinal axis connects the roller tappet to a reciprocating element of the fuel unit pump. A cam roller contacts a cam lobe of a rotatable shaft of the internal combustion engine. The cam roller is rotatably mounted to the roller tappet body around a cam roller rotation axis. The external surface of the roller tappet body is configured to allow tilting of the roller tappet within the roller tappet bore to align the roller tappet with respect to the cam lobe of the rotatable shaft.

Advantageously, tilting of the cam roller compensates for possible misalignments between the cam roller and the cam lobe of the rotatable shaft, which is typically the camshaft. As a result, forces between the two elements can be transmitted effectively, in particular avoiding concentration of forces on the small surface of the cam roller. In fact the tilting of the roller tappet body, which carries the cam roller, allows a better engagement between the external surface of the cam roller and the external surface of the cam lobe of the rotatable shaft. In more detail, the roller tappet body is tilted until the maximum contact area between the cam roller and the cam lobe is assured when the cam roller contacts the rotatable shaft (i.e. the cam lobe of the rotatable shaft). Typically, the roller tappet body is tilted until the cam roller rotation axis is parallel to the rotation axis of the rotatable shaft.

It should be noted that the roller tappet body is typically a rigid element, so that "tilting" means a rigid rotation. In other words, the roller tappet body is substantially not deformed during tilting, i.e. the shape of the roller tappet body is substantially unchanged during tilting of the roller tappet body.

According to an embodiment, the external surface of the roller tappet body is configured to allow tilting of the body longitudinal axis substantially along a tilting plane including the body longitudinal axis. This allows a precise and effective alignment operation of the cam roller. In particular, in an embodiment, the tilting plane includes also the cam roller rotation axis. This kind of movement of the roller tappet has proven to be particularly effective.

According to an embodiment, the width of the roller tappet body, measured perpendicularly to the body longitudinal axis on a plane including the body longitudinal axis and being parallel with respect to the cam roller rotation axis, varies along the body longitudinal axis to allow tilting of the roller tappet within the roller tappet bore. Variation of the width allows to effectively shape the roller tappet body (in particular its external surface) to allow tilting of the roller tappet within the relevant roller tappet bore.

According to an embodiment, the width of the roller tappet body, measured perpendicularly to the body longitudinal axis on a plane including the body longitudinal axis and being parallel with respect to the cam roller rotation axis, has a width maximum value at a first portion of the roller tappet body, and a second portion width value at a second portion arranged above the first portion, and a third portion width value at a third portion placed below the first portion, the second value and the third value being smaller than the width maximum value. In particular, the second and third portion width values allow tilting (i.e. Integral rotation) of the roller tappet body within the roller tappet bore, which is typically cylindrical.

As used herein, the terms "above" and "below" have the meaning that can be inferred from the figures, i.e. a first element is above the second element if the distance between the first element and the cam roller, measured along the body longitudinal axis, is smaller than the distance between the second element and the cam roller, measured in the same manner. In other words, the roller tappet body is provided with a portion having the width maximum value, and above and below these portions, the width of the roller tappet body is less than the width maximum value. As a result, interference between the second and third portion with the roller tappet bore is avoided, to allow the tilting movement of the roller tappet body.

The maximum width of the roller tappet at the first portion is typically dimensioned to provide a small clearance between the roller tappet bore and the roller tappet body. As a result, translations of the roller tappet are avoided (or greatly limited). In other words, when there is a misalignment between the cam roller and the cam lobe of the rotatable shaft, the roller tappet body is preferably tilted, but it is not translated.

The height (i.e. the dimension measured along the body longitudinal axis) of the first portion having a width equal to the width maximum value is typically small if compared to the height of the roller tappet body. In other words, the first portion is typically shaped substantially as a cylinder, having a reduced height and a having the width maximum value as a diameter. In some embodiments, the height of the cylinder is so greatly reduced, that the first portion substantially coincides with a section of the roller tappet body.

According to an embodiment, the external surface of the roller tappet body is configured to substantially prevent tilting of the body longitudinal axis when the roller tappet is within the roller tappet bore along a non-tilting plane being substantially perpendicular to the cam roller rotation axis. As a result, it is possible to avoid those movements of the roller tappet that do not contribute to the alignment between the rotatable shaft and the cam roller. These movements can be in fact detrimental for the operation of the cam roller.

According to an embodiment, a second portion depth value of the roller tappet body, measured perpendicularly to the body longitudinal axis on a plane including the body longitudinal axis and being perpendicular to the cam roller rotation axis, is greater than the second portion width value. This helps in defining a tilting plane and a non-tilting plane for the body longitudinal axis. In fact, because the width has a reduced value, there is a certain clearance between the roller tappet body and the roller tappet bore that allows movement (i.e. tilting) of the roller tappet along the tilting plane. On the contrary, because the depth has a greater value, there is small clearance between the roller tappet body and the roller tappet bore, so that movement (i.e. tiling) of the roller tappet is substantially prevented along the non-tilting plane, which is perpendicular with respect to the tilting plane. In other words, considering a plant view of the roller tappet, movement of the roller tappet is allowed along a direction parallel to the width of the roller tappet, and movement is substantially prevented along a direction parallel to the depth of the roller tappet body.

According to an embodiment, the second portion depth value is substantially equal to the depth maximum value of the roller tappet body, which is in turn preferably substantially equal to the width maximum value of the roller tappet body. This further helps to avoid tilting of the roller tappet body along the non-tilting plane.

According to an embodiment, the third portion depth value of the roller tappet body, measured perpendicularly to the body longitudinal axis on a plane including the body longitudinal axis and being perpendicular to the cam roller rotation axis, is greater than the third portion width value. According to an embodiment, the third portion depth value is substantially equal to the depth maximum value of the roller tappet body, which is in turn preferably substantially equal to the width maximum value of the roller tappet body. As for the second portion, the relationship between the above mentioned dimensions helps to effectively define the degrees of freedom of the roller tappet.

However, in different embodiments, it may be useful to provide a greater degree of freedom for the roller tappet. In such an embodiment, a second portion depth value of the roller tappet body, measured perpendicularly to the body longitudinal axis on a plane including the body longitudinal axis and being perpendicular to the cam roller rotation axis, is substantially equal to the second portion width value, and/or a third portion depth value of the roller tappet body, measured perpendicularly to the body longitudinal axis on a plane including the body longitudinal axis and being perpendicular to the cam roller rotation axis, is substantially equal to the third portion width value According to an embodiment, the roller tappet body is provided with a pump seat, having a pivoting area to allow pivoting of the roller tappet body around an end of a reciprocating element of the fuel unit pump. This facilitates tilting movement of the roller tappet.

According to an embodiment, the width of the roller tappet body, measured perpendicularly to the body longitudinal axis on a plane including the body longitudinal axis and being parallel with respect to the cam roller rotation axis, has a width maximum value at the height of the pivoting area. As a result, an end of the reciprocating element of the fuel unit pump can be effectively used as a fulcrum during the tilting movement of the roller tappet.

An embodiment of the present disclosure further provides for a fuel unit pump provided with a reciprocating element and with a roller tappet according to one or more of the preceding aspects.

An embodiment of the present disclosure further provides for an internal combustion engine provided with a roller tappet bore and with a fuel unit pump of the above mentioned embodiment.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
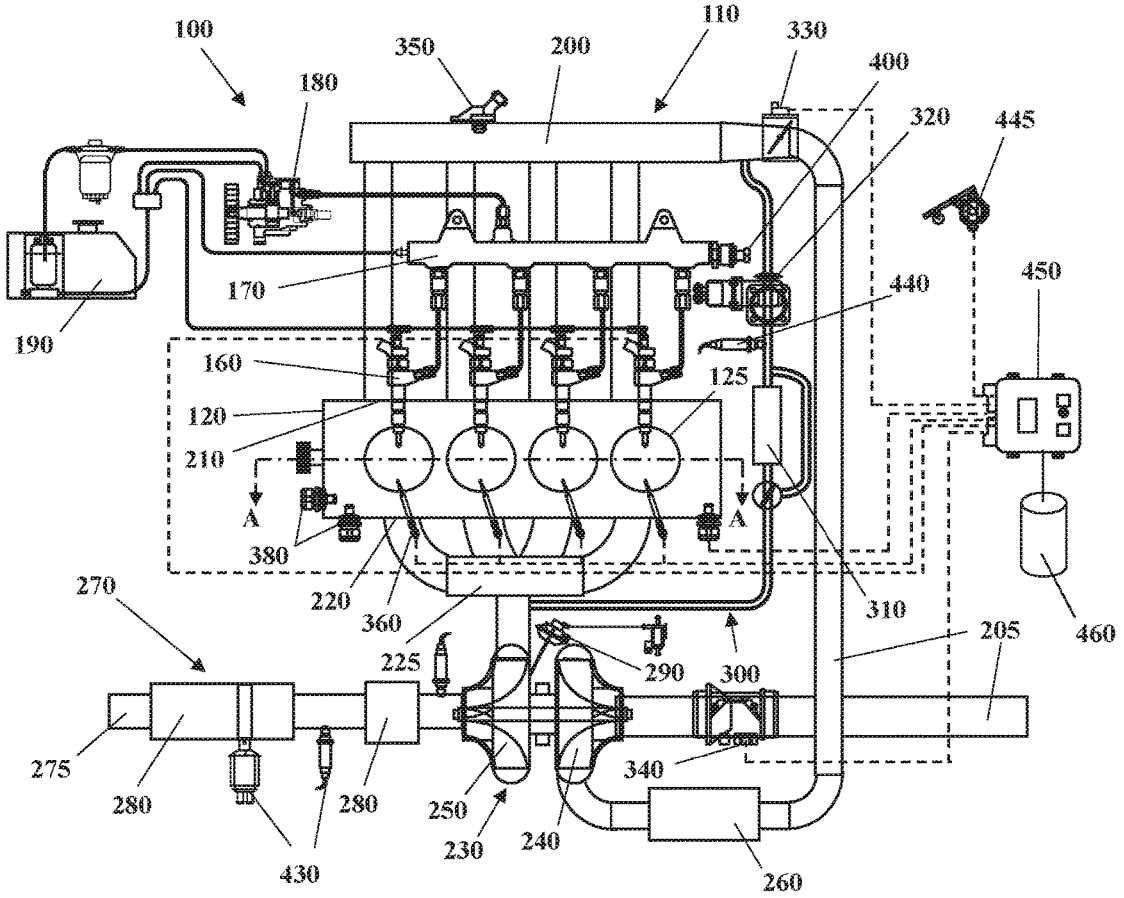
FIG. 1 shows an embodiment of an automotive S stem including an internal combustion engine.
Figure 2:
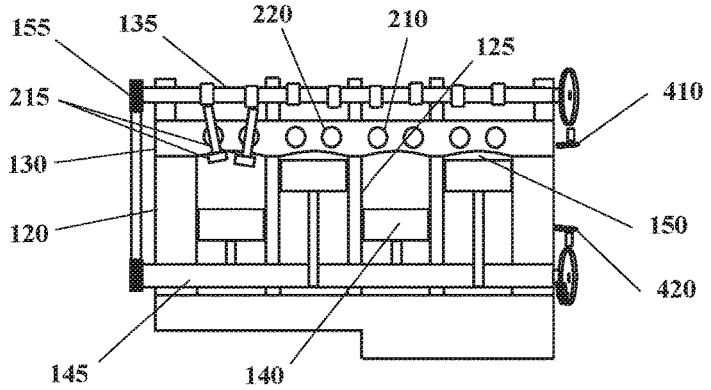
FIG. 2 is a cross-section according to the plane A-A of an internal combustion engine belonging to the automotive system of FIG. 1.

Some embodiments may include an automotive system 100, as shown in FIGS. 1 and 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150. A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel pump that increase the pressure of the fuel received from a fuel source 190. According to a possible embodiment, the engine includes a fuel unit pump 180 that is actuated by the rotation of a camshaft 135. Each of the cylinders 125 has at least two valves 215, actuated by the camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust system 270 may include an exhaust pipe 275 having one or more exhaust aftertreatment devices 280. The aftertreatment devices may be any device configured to change the composition of the exhaust gases. Some examples of aftertreatment devices 280 include but are not limited to, catalytic converters (two and three way), oxidation catalysts, lean $NO_x$ traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal position sensor 445. Furthermore, the ECU 450 may generate output signals to various control devices that are arranged to control the operation of the ICE 110, including, but not limited to, the fuel unit pump 180, fuel injectors 160, the throttle body 330, the EGR Valve 320, the VGT actuator 290, and the cam phaser 155. Note, dashed lines are used to indicate communication between the ECU 450 and the various sensors and devices, but some are omitted for clarity.

Turning now to the ECU 450, this apparatus may include a digital central processing unit (CPU) in communication with a memory system 460, or data carrier, and an interface bus. The CPU is configured to execute instructions stored as a program in the memory system 460, and send and receive signals to/from the interface bus. The memory system may include various storage types including optical storage, magnetic storage, solid state storage, and other non-volatile memory. The interface bus may be configured to send, receive, and modulate analog and/or digital signals to/from the various sensors and control devices.

Instead of an ECU 450, the automotive system 100 may have a different type of processor to provide the electronic logic, e.g. an embedded controller, an onboard computer, or any processing module that might be deployed in the vehicle.

With reference again to fuel injection of the internal combustion engine 110, a fuel unit pump 180 is connected to a fuel source 190, from which the fuel is provided. The fuel unit pump 180 is connected to one or more fuel injectors 160 (injector nozzle), preferably by a fuel rail 170. According to an embodiment, the fuel unit pump 180 includes a reciprocating element 180*b* that is movable, inside the body of the fuel unit pump 180, for operating in a known manner the fuel unit pump, i.e. to allow drawing of fuel from the fuel source 190 and for pressurizing it before the delivery to the fuel injector 160.

More in detail, the fuel is supplied to the fuel injector 160 from the fuel unit pump 180 in response to a reciprocating movement of the reciprocating element 180*b*. In particular, the reciprocating element 180*b* is movable between a non-operative position, in which it is extracted from the body of the fuel unit pump 180, or from a chamber provided therein, and an operative position, e.g. a pumping position, in which it is moved inside the body of the fuel unit pump. Returning means, such as for example a spring 180*a*, are provided to maintain the reciprocating element 180*b* of the fuel unit pump 180 in-operative position.

According to an embodiment of the present disclosure, the internal combustion engine 110 is provided with a rotatable shaft. Preferably, the rotatable shaft is chosen between the camshaft 135, the crankshaft 145 and a balance shaft (not shown in detail). In the shown embodiment, the rotatable shaft is the camshaft 135. Reference will be thus made to the camshaft 135, but the following discussion applies as well to other rotating shafts, e.g. the crankshaft 145 and a balance shaft. The rotatable shaft may be chosen with freedom within the internal combustion engine, provided that it can provide a stable rotation for the actuation of the fuel unit pump 180.

In more detail, the reciprocating element 180*b* of the fuel unit pump 180 is provided with a roller tappet 1, typically mounted at an end of the reciprocating element 180*b*. The engagement between the roller tappet 1 and the camshaft 135 is of the cam—cam follower kind, wherein the camshaft is the cam and the roller tappet 1 is the cam follower. In other words, in a known way, the engagement between the camshaft 135 and the roller tappet 1 provides that when the camshaft 135 rotates, the roller tappet 1 reciprocates, i.e. it moves with a substantially linear movement into the relevant seat. In particular, the internal combustion engine 110, typically the cylinder head 130 is provided with a roller tappet bore 111 into which, in operative conditions, the roller tappet 1 reciprocates. The roller tappet bore 111 is typically machined as a cylindrical hole.

According to an embodiment, the roller tappet 1 includes a roller tappet body 10 and a cam roller 12. The cam roller 12 is rotatably mounted to the roller tappet body 10. Various embodiments provide different ways to rotatably mount the cam roller 12 to the roller tappet body 10. In particular, in the shown embodiment, the cam roller 12 is coupled to a pin 11. The pin 11 is fixed to the roller tappet body 10, and the cam roller 12 is rotatable around the pin 11, e.g. by means of bearings, not shown. In a different embodiment, the pin 11 can be rotatable with respect to the roller tappet body 10, while the pin 11 and the cam roller 12 are fixed one to the other. Furthermore, in a further embodiment, the pin 11 can be rotatable with respect to the roller tappet body 10, and the cam roller 12 can be in turn rotatable with respect to the pin 11. Also, in different embodiments, the pin 11 can be omitted. As an example, the roller tappet body can be provided with cylindrical protrusions, and the cam roller may be provided with cylindrical seats for these protrusions, or vice versa.

In general, the can roller 12 is rotatably mounted on the roller tappet body 10 so as to rotate around a cam roller rotation axis RA. The roller tappet body 10 has a body longitudinal axis BLA which is oriented as per the main direction of extension of the roller tappet body 10, and that is typically perpendicular with respect to the cam roller rotation axis RA. The external surface 10*a* of the roller tappet body 10 is configured to allow tilting of the roller tappet 1 within the roller tappet bore 111.

As mentioned, this tilting allows the alignment between the cam roller 12 and the cam lobe 135*a*. In particular, tilting of the roller tappet 1 allows alignment between the cam roller rotation axis RA and the axis of rotation of the cam lobe 135*a* (i.e. the axis of rotation of the camshaft 135). Preferably, such a tilting occurs so that the body longitudinal axis BLA is tilted along a tilting plane TP that includes the body longitudinal axis BLA itself. In other words, the movement of the body longitudinal axis BLA is substantially planar. Preferably, the tilting plane includes also the cam roller rotation axis RA. As a result, the cam roller rotation axis RA is also moved (i.e. tilted) in a substantially planar manner.

It is to be understood that with "tilting" a substantially rotational movement is meant. Such a rotation can have an axis of rotation that is constant for the whole "tilting" movement, or it can also vary (typically a small variation) over time. In other words, the axis of rotation of the tilting movement can vary its position in time during the tilting movement itself. This is due to the fact that the roller tappet 1 is not rigidly pivoted to the fuel unit pump, but it can freely move within the roller tappet bore of the latter.

As mentioned, this is typically achieved by proper dimensioning the roller tappet body 10, and in particular the external surface 10*a* of the roller tappet body 10. More in detail, the external surface 10*a* of the roller tappet body 10 provides for a certain clearance between the roller tappet body 10 and the roller tappet bore 111, so as to allow movement of the first within the latter. However, if all the dimensions of the roller tappet body are downsized, i.e. providing an excessive clearance all around the roller tappet body 10, the roller tappet may be provided with a too high degree of freedom. Moreover, such a roller tappet body may be translated within the roller tappet bore 111, along directions perpendicular to the body longitudinal axis BLA. Such a movement is undesired, and it may not effectively solve the problem of the relative orientation between the camshaft 135 and the cam roller 12.

According to an embodiment, the external surface 10*a* of the roller tappet body 10 is thus dimensioned so as to allow only certain kinds of movements. In particular, the dimensions of the roller tappet body 10 are downsized only in particular points, to allow some movements (e.g. tilting movement of the body longitudinal axis BLA along the tilting plane TP) and to prevent other movements (e.g. translation within the roller tappet bore along directions perpendicular to the body longitudinal axis BLA).

In the following, reference to width and depth of the roller tappet body 10 (and to different portions of the roller tappet body 10) will be made. The dimension "width" is measured on a plane MP1 including the body longitudinal axis BLA and being parallel with respect to the cam roller rotation axis RA. On plane MP1, the width is measured along a direction parallel to the cam roller rotation axis RA. "Depth" is measured orthogonally with respect to the width and to the body longitudinal axis BLA. In more detail, the dimension "depth" is measured on a plane MP2 including the body longitudinal axis BLA and being perpendicular to the cam roller rotation axis RA. On plane MP2, the depth is measured along a direction perpendicular to the body longitudinal axis BLA.

According to an embodiment, the width of the roller tappet body 10 has a width maximum value Wmax at a first portion P1 of the roller tappet body 10. The roller tappet body is further provided with a second portion P2 above the first portion P1, and with a third portion P3 below the first portion. The second portion width value W2 and the portion width value W3 are smaller than the width maximum value Wmax, to allow tilting of the roller tappet 1 within the roller tappet bore 111, which is typically a cylindrical bore having a diameter substantially equal to (slightly greater than) the width maximum value Wmax. It has to be noted that reference is made to three different portions P1, P2, P3 of the roller tappet body 10. These portions are typically part of a single one piece element, i.e. the roller tappet body 10. As a result the "portions" of the roller tappet body 10 can be zones of a single element (e.g. zones of a roller tappet body made as a one piece element).

A "portion" is a zone of the roller tappet body 10 provided with substantially the same width for its whole height. In the shown embodiment, the width maximum value Wmax is placed at a single height of the roller tappet body 10, so that the first portion P1 is substantially a cross section of the roller tappet body 10. Similarly, the width of the roller tappet body 10 varies continuously above and below the first portion P1, so that the second portions P2 and the third portion P3 are also substantially two cross sections of the roller tappet body 10. In different embodiments, one or more of the portions P1, P2, P3 can have a greater height with respect to the shown embodiment, i.e. they can be a portion having a constant width for a certain height.

Preferably, at least the first portion P1 is provided with a height sensibly smaller than the height of the roller tappet body 10, to allow tilting of the roller tappet within the roller tappet bore. A first portion P1 that is too high may in fact limit (at worst prevent) the tilting of the roller tappet 1, because of the interference between the lateral surface of the first portion P1 with the internal surface of the roller tappet bore 111.

Figure 3:
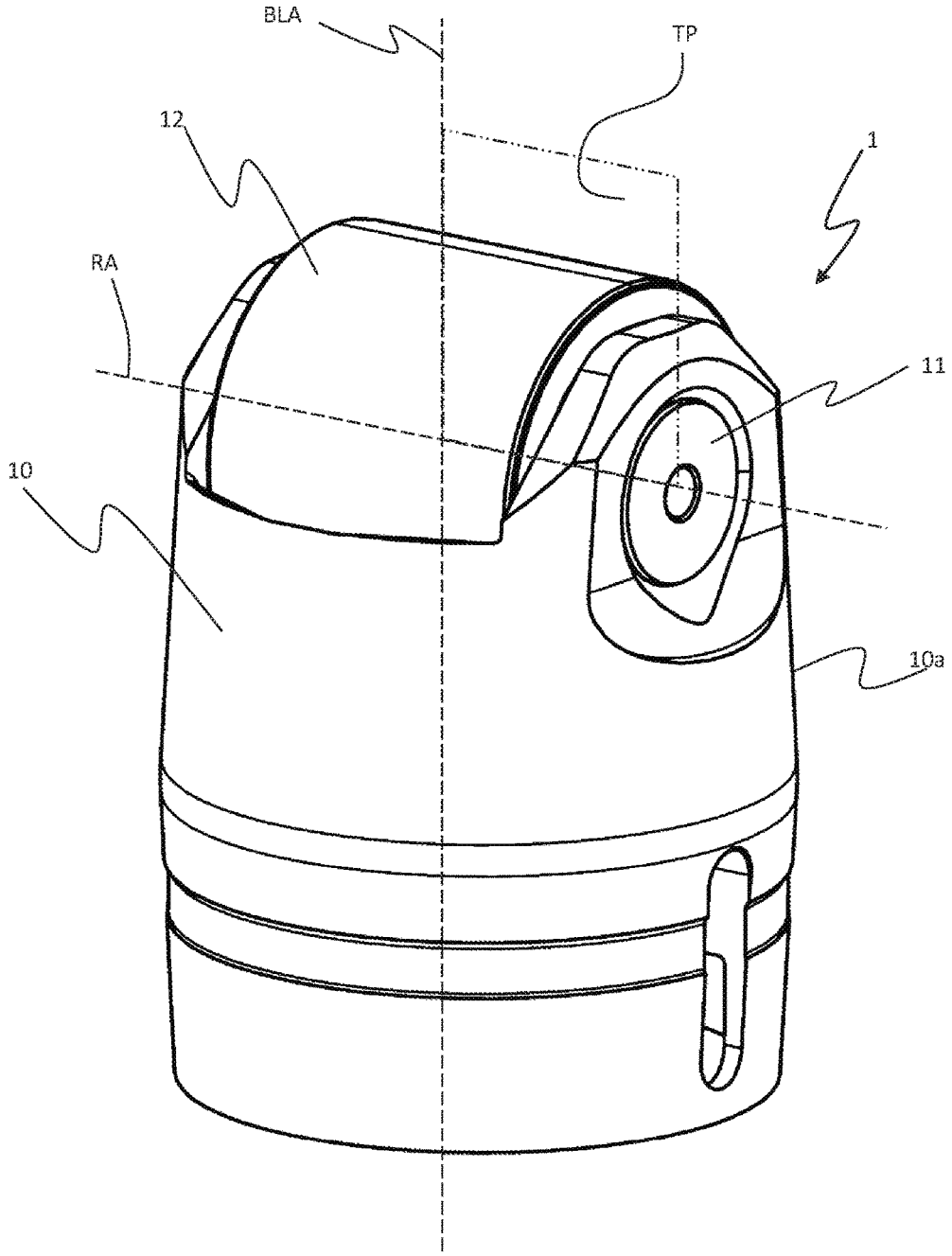
FIG. 3 is a perspective view of the roller tappet of FIG. 1.
Figure 4:
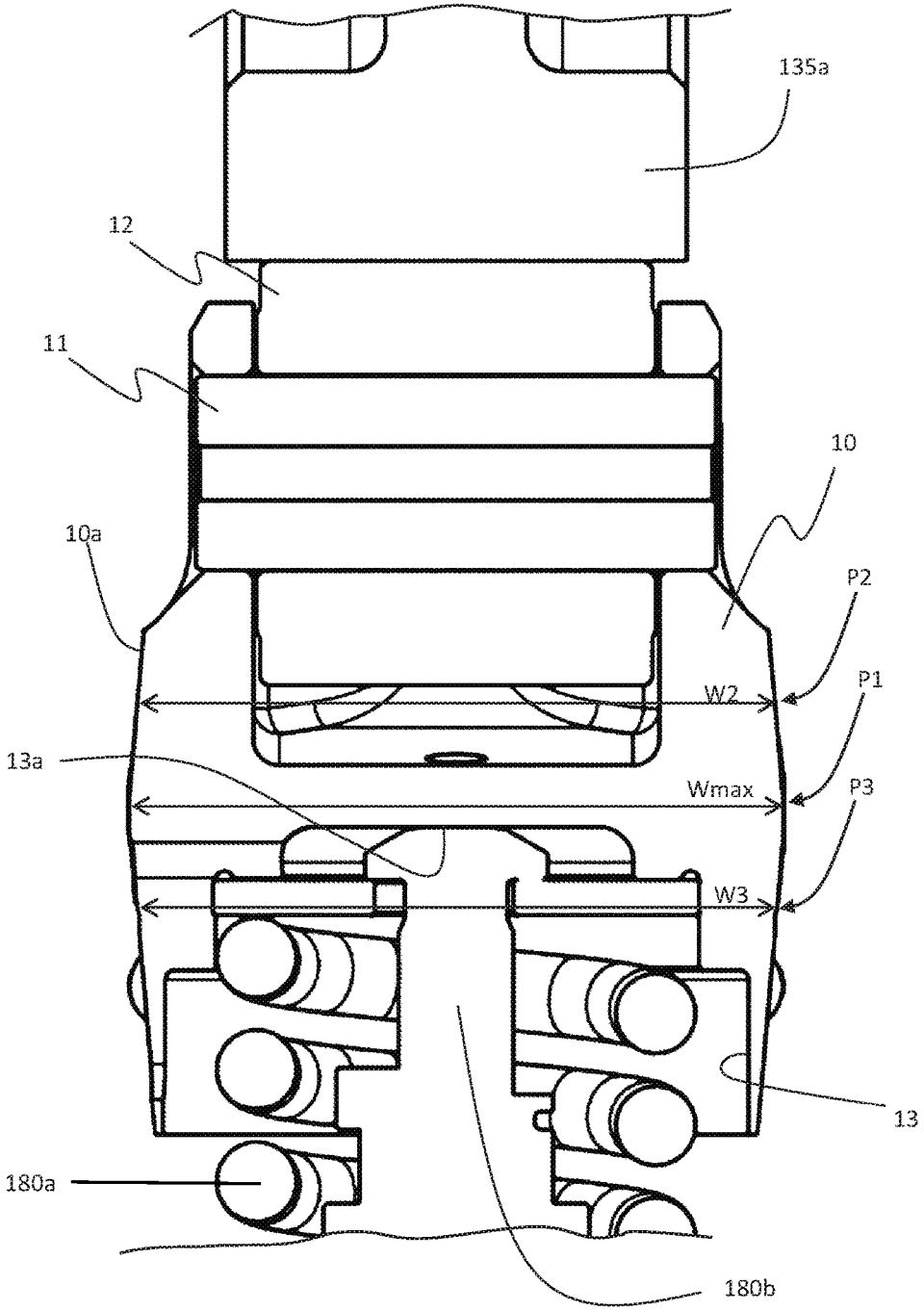
FIG. 4 is a sectional schematic view of the roller tappet of FIG. 1 in operative condition.

According to an embodiment, the three portions P1, P2 and P3 can have width equal to their relevant depth, so that the roller tappet 1 is substantially barrel shaped (e.g. the embodiment of FIG. 4), or substantially conical (e.g. the embodiment of FIG. 3). In these embodiments, the roller tappet 1 can substantially be tilted along every plane including the body longitudinal axis BLA. In other words, according to an embodiment, the depth value D1 of the first portion P1 is equal to Wmax, the depth value D2 of the second portion is equal to W2, and the depth value D3 of the third portion is equal to W3.

More in general, an embodiment of the present disclosure provides that the depth value D1 of the first portion P1 is greater than the depth values D2 and D3 of the second and third portions P2, P3 respectively, wherein D1 can be different from Wmax, as well as D2 and D3 can be different from W2 and W3 respectively.

Figure 9:
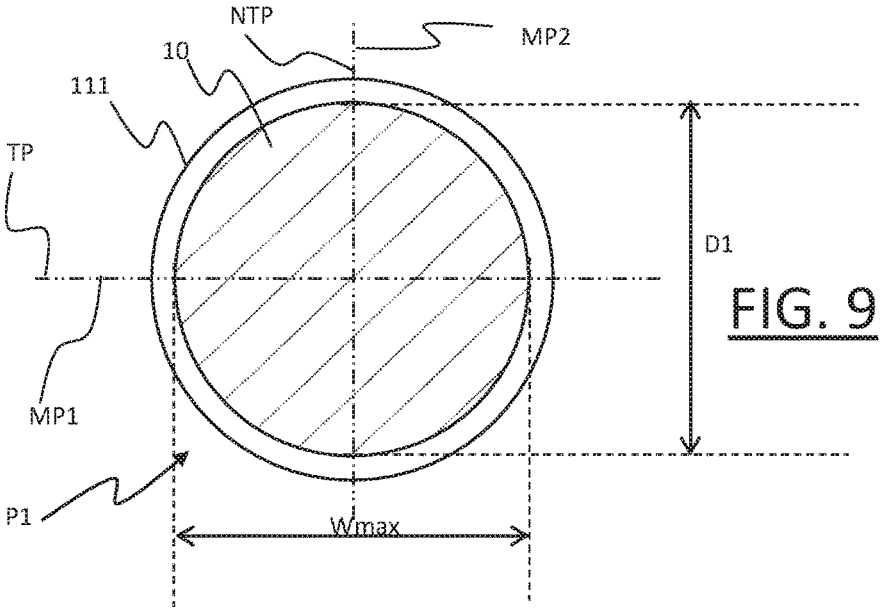
FIG. 9 is a sectional schematic view at a portion of a roller tappet according to another embodiment.
Figure 10:
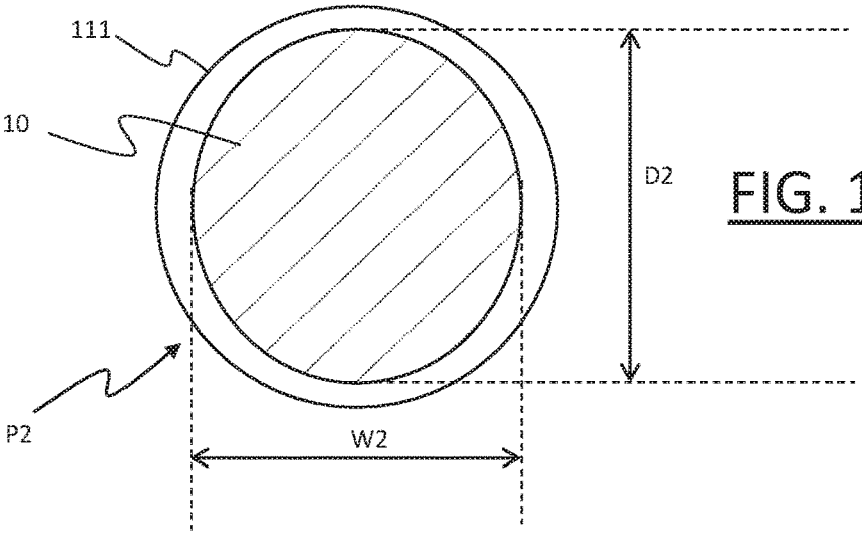
FIG. 10 is a sectional schematic view at a second portion of a roller tappet according to the embodiment shown in FIG. 9.
Figure 11:
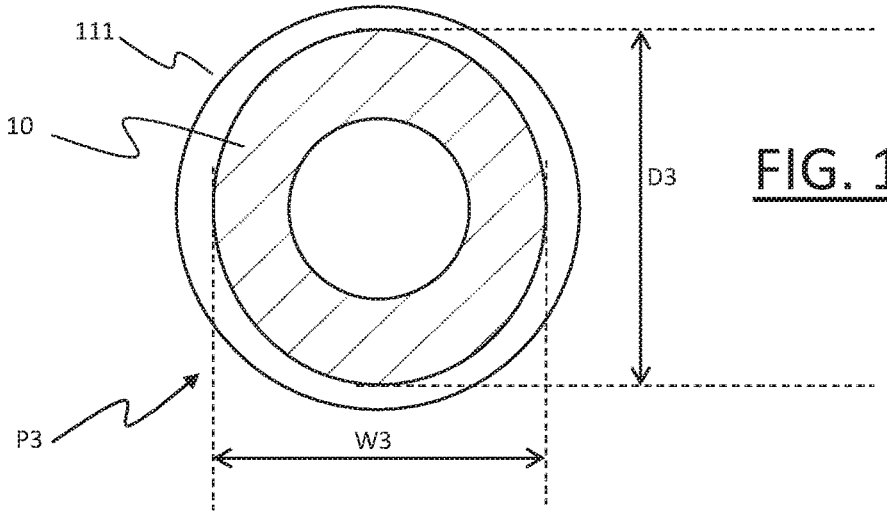
FIG. 11 is a sectional schematic view at a third portion of a roller tappet according to the embodiment shown in FIG. 9.

According to another embodiment, shown schematically in FIGS. 9-11, the external surface 10*a* of the roller tappet body 10 can be configured to substantially prevent tilting of the body longitudinal axis 10*a*, when the roller tappet 1 is within the roller tappet bore 111, along a plane perpendicular to a non-tilting plane NTP being substantially perpendicular to the cam roller rotation axis RA. In other words, the external surface 10*a* of the roller tappet body 10 is preferably configured so that tilting of the body longitudinal axis BLA occurs on a plane parallel to the axis of the camshaft 135, while tilting is prevented on a plane perpendicular to the camshaft 135.

Different configurations exist that allow the above mentioned aspects. In the figures, a preferred embodiment is shown. In the shown embodiment, the second portion depth value D2 (i.e. the depth of the second portion P2) and the third portion depth value D3 are greater respectively than the second portion width value W2 and the third portion width value W3 (i.e. D2>W2 and D3>W3). As a result, the reduced value of the widths W2 and W3 provide for a certain clearance between the roller tappet body 10 and the roller tappet bore 111 in the direction of the width. Such a clearance allows tilting of the body longitudinal axis BLA of the roller tappet 10 along the tilting plane TP. On the contrary, the reduced clearance between the roller tappet body 10 and the roller tappet bore 111 in the direction of the depth substantially prevents tilting of the body longitudinal axis BLA of the roller tappet body 10 along the non-tilting plane NTP.

According to an embodiment, the second portion depth value D2 and the third portion depth value D3 are substantially equal one to the other, and they are also preferably substantially equal to the first portion depth value D1 According to an embodiment, the second portion depth value D2 and the third portion depth value D3 are substantially equal to the depth maximum value of the roller tappet body 10, in order to minimize the above mentioned clearance between the roller tappet body 10 and the roller tappet bore 111 in the direction of the depth to avoid tilting of the roller tappet 1 along the non-tilting plane. Typically, the depth maximum value of the roller tappet body 10 is substantially equal to the width maximum value Wmax.

Different alternatives are possible. As an example, the second portion depth value D2 and the third portion depth value D3 can be different from one to the other. Moreover, only one portion between portions P2 and P3 may have a depth value greater than the width value. As an example, in an embodiment, not shown, the second portion depth value D2 can be equal to the second portion width value W2 (e.g. the second portion depth value D2 can be smaller than the depth maximum value) while the third portion depth value D3 can be substantially equal to the depth maximum value. In fact, it is possible to prevent rotation around the non-tilting plane by properly dimensioning the depth of only one of the portions of the roller tappet body 10.

In a further embodiment, the first portion can be provided with the width maximum value Wmax but not with the depth maximum value, that can be provided at one (or both) of the portions between the second portion P2 and the third portion P3. In other words, the first portion P1 can have a width greater than both the width of the second portions and the third portion, and a depth smaller than one (of both) of depths of the second portion and the third portion. Such a configuration may in fact allow tilting of the roller tappet 1 along the tilting plane TP, while substantially preventing tilting of the roller tappet 1 along the non-tilting plane NTP.

In general, the width of the roller tappet body 10 is varied along the body longitudinal axis BLA so as to allow tilting (i.e. Integral rotation) of the roller tappet 1 (i.e. of the body longitudinal axis BLA) along the tilting plane TP. Preferably, the depth of the roller tappet body 10 is dimensioned (in particular it may either vary or be constant) along the body longitudinal axis BLA so as to prevent tilting of the roller tappet 1 (i.e. of the body longitudinal axis BLA) along the non-tilting plane NTP.

According to an embodiment, the roller tappet body 10 is provided with a pump seat 13. In particular, the pump seat 13 is configured to cooperate with an end of the reciprocating element 180*b*. The pump seat 13 is typically a recess or cavity within the roller tappet body 10, oriented as per the body longitudinal axis, so that the roller tappet body is partially hollow. As a result, during mounting of the roller tappet 1 to the reciprocating element 180*b* of the fuel unit pump 180, the reciprocating element 180*b* is partially inserted within the pump seat 13. The pump seat 13 is typically provided with a pivoting area 13*a*, typically a flat surface, which, in operative condition, abuts against the reciprocating element 180*b*. In more detail, in operative condition, an end of the reciprocating element 180*b* leans on pivoting area 13*a* so that, when the roller tappet 1 is tilted, an end of the reciprocating element 180*b* acts as a fulcrum.

Preferably, the pivoting area 13*a* is arranged at the same height along the body longitudinal axis BLA with respect to the width maximum value Wmax of the roller tappet body 10. With reference to the above mentioned embodiment, shown in the figures, the pivoting area 13*a* is preferably arranged at the same height of the first portion P1.

Figure 5:
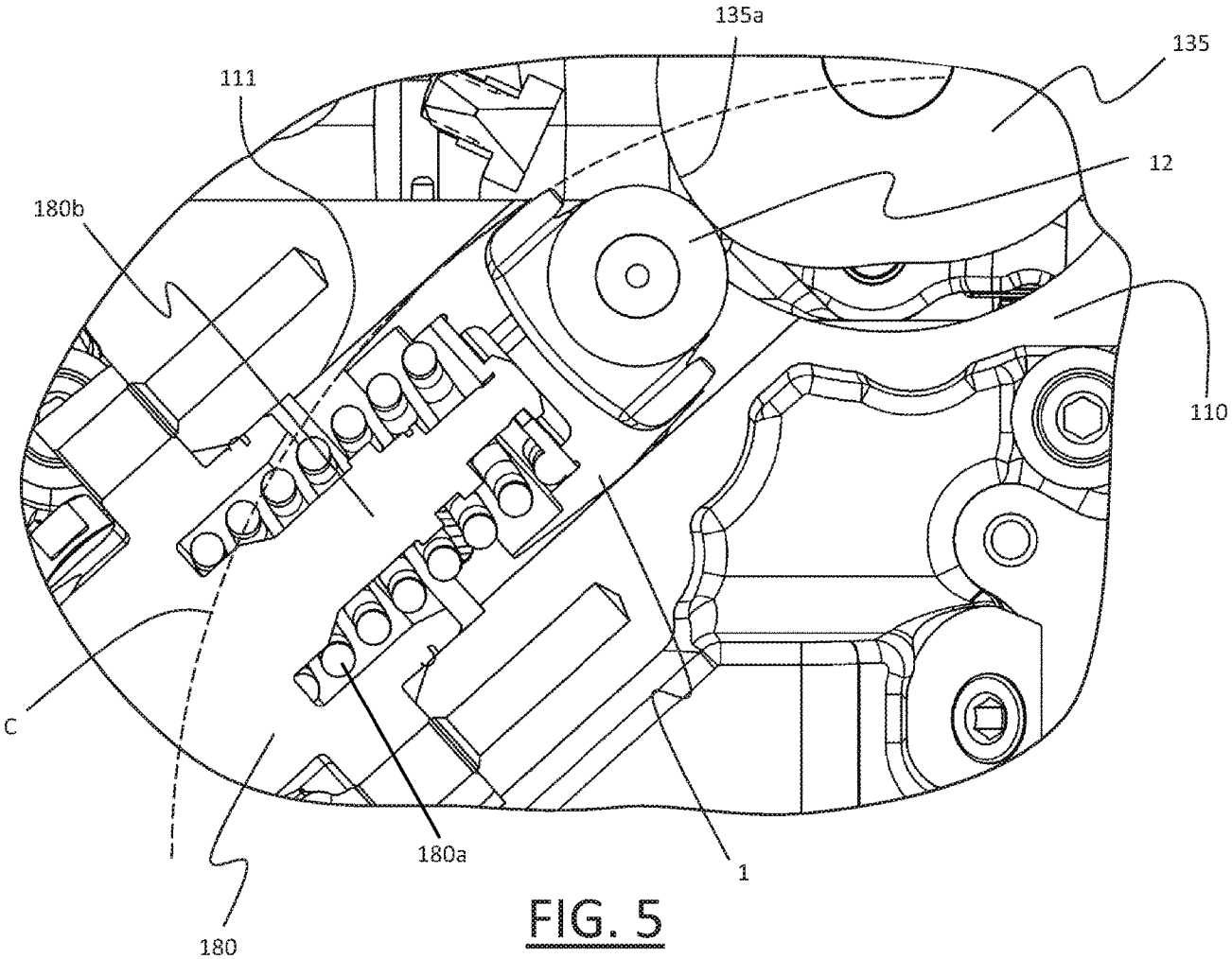
FIG. 5 is a sectional schematic view of another embodiment of a roller tappet and of a fuel unit pump in operative condition.
Figure 6:
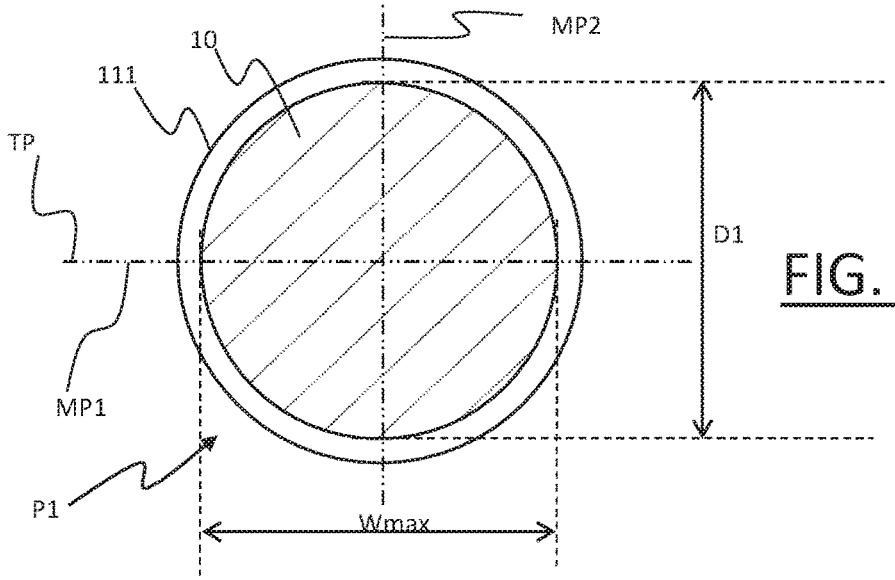
FIG. 6 is a sectional schematic view at a first portion of the roller tappet according to an embodiment.
Figure 7:
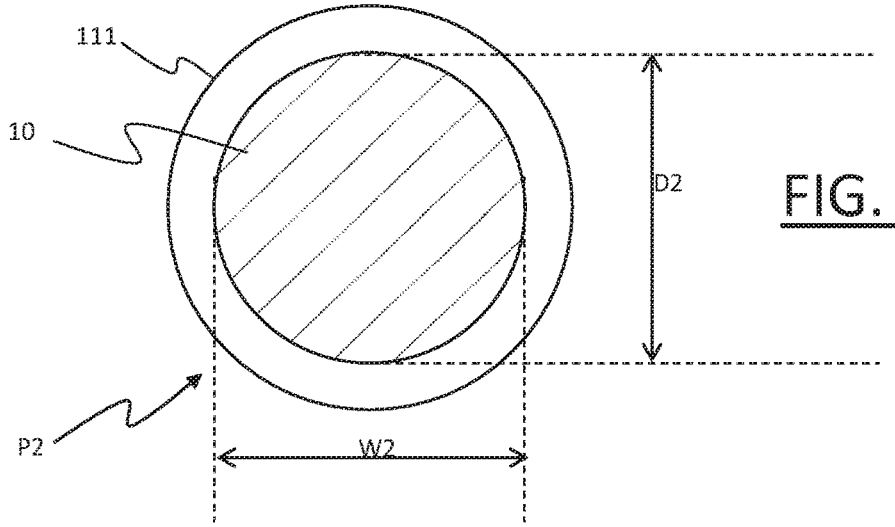
FIG. 7 is a sectional schematic view at a second portion of a roller tappet according to the embodiment shown in FIG. 6.
Figure 8:
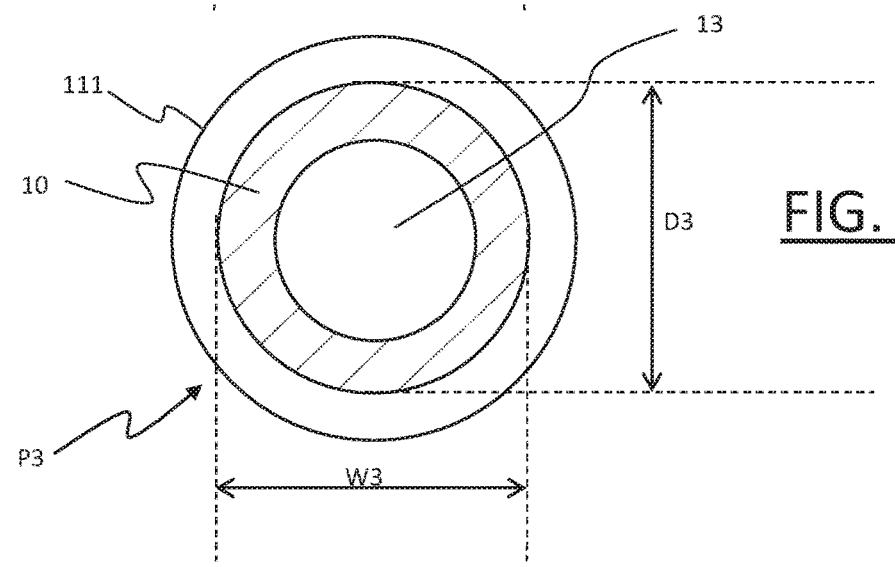
FIG. 8 is a sectional schematic view at a third portion of a roller tappet according to the embodiment shown in FIG. 6.

As mentioned, various configurations of the external surface are possible. In particular, the perimeter of the roller tappet body 10, viewed on a sectional plane including the body longitudinal axis BLA and being parallel to the cam roller rotation axis RA can have various configurations. In particular, part of the perimeter of the roller tappet body 10 can be defined by various kinds of curves C, e.g. a circular curve (as shown in FIG. 5), a parabolic curve, a logarithmic curve, etc. Moreover, in further embodiments, part of the perimeter can be angled, e.g. In the embodiment of FIG. 4, where part of the roller tappet body has a conical (or better frustoconical) shape, i.e. of two cones joined at their bases.

In more detail, with reference to the embodiment shown in FIG. 5, part of the perimeter of the roller tappet body 10, viewed on a sectional plane including the body longitudinal axis BLA and being perpendicular to the cam roller rotation axis RA, is substantially circular. In other words, after cutting the roller tappet body 10 with a sectional plane as per above, part of the roller tappet body 10 has a substantially circular perimeter. This provides for the above mentioned "barrel" shape. In particular, the perimeter of the roller tappet body is partially defined by a curve C that is circular.

The first portion P1 coincides with a cross section of the roller tappet body 10, cut on a plane perpendicular to the body longitudinal axis BLA, at the height of the diameter of the circle defined by the curve C. The second portion P2 and the third portion P3 thus coincided with two cross sections parallel to the cross section of the first portion P1, above and below the diameter of the circular curve C respectively. As mentioned, in different embodiments, the width (and possibly also the depth) of the roller tappet body 10 can decrease substantially linearly starting from the first portion P1, above and below the first portion P1, so as to provide for a roller tappet body having a conical (or better frustoconical) shape, i.e. of two cones joined at their bases.

During operation of the internal combustion engine 110, the camshaft 135 is rotated. The cam roller 12 is coupled to the camshaft 135 and in particular with the cam lobe(s) 135*a* of the camshaft 135. The roller tappet 1 is arranged in the roller tappet bore 111, inside which it can reciprocate substantially along the longitudinal body axis BLA. As mentioned above, the roller tappet 1 follows the movement of at least one cam lobe 135*a* of a camshaft 135 of the internal combustion engine 110. The coupling between the roller 12 and the camshaft 135 causes the tilting of the roller tappet body 10 in the case the cam roller 12 and the camshaft 135 (in particular the cam lobe 135*a*) are not aligned.

More in detail, the roller tappet 1 is tilted with respect to the reciprocating element 180*b* of the fuel unit pump 180 (preferably along the tilting plane TP) if the cam roller 12 and the camshaft 135 are not aligned (i.e. typically when the camshaft is not parallel with the cam roller rotation axis RA). By doing so, the cam roller 12 is tilted, too, so as to properly engage the cam lobe 135*a* of the camshaft 135, typically so as to be parallel to the camshaft. This allows an efficient transmission of the rotary movement of the camshaft 135 to the reciprocating element 180*b* by means of the roller tappet 1 of the fuel unit pump 180, without increasing contact stresses between the roller 12 and the cam lobe 135*a* of the camshaft 135. Moreover, the rotation of the camshaft 135, and thus of the can lobe(s) 135*a*, causes the reciprocation of the roller tappet 1 and thus of the reciprocating element 180*b* along the longitudinal movement direction. As before explained, this alternate movement allows pumping of fuel to the injectors 160.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A roller tappet for a fuel unit pump of an internal combustion engine having a roller tappet bore for receiving the roller tappet within the internal combustion engine, the roller tappet comprising:

a roller tappet body having a body longitudinal axis for connecting the roller tappet to a reciprocating element of the fuel unit pump; and a cam roller configured to contact a cam lobe of a rotatable shaft of the internal combustion engine, the cam roller being rotatably mounted to the roller tappet body around a cam roller rotation axis;

wherein an external surface of the roller tappet body is configured to allow tilting of the roller tappet within the roller tappet bore substantially along a tilting plane including the body longitudinal axis and the cam roller axis to align the roller tappet with respect to the cam lobe of the rotatable shaft.

2. The roller tappet according to claim 1, wherein a width of the roller tappet body measured perpendicularly to the body longitudinal axis on a plane includes the body longitudinal axis and being parallel with respect to the cam roller rotation axis, varies along the body longitudinal axis to allow tilting of the roller tappet within the roller tappet bore.

3. The roller tappet according to claim 1, wherein the external surface of the roller tappet body is configured to substantially prevent tilting of the body longitudinal axis when the roller tappet is within the roller tappet bore along a non-tilting plane which is substantially perpendicular to the cam roller rotation axis.

4. The roller tappet according to claim 1, a width of the roller tappet body measured perpendicularly to the body longitudinal axis on a plane includes the body longitudinal axis, and being parallel with respect to the cam roller rotation axis, has a width maximum value at a first portion of the roller tappet body, a second portion width value at a second portion arranged above the first portion, and a third portion width value at a third portion placed below the first portion, the second portion width value and the third portion width value being less than the width maximum value.

5. The roller tappet according to claim 4, wherein a second portion depth value of the roller tappet body, measured perpendicularly to the body longitudinal axis on a plane including the body longitudinal axis, and being perpendicular to the cam roller rotation axis, is greater than the second portion width value.

6. The roller tappet according to claim 5, wherein a third portion depth value of the roller tappet body, measured perpendicularly to the body longitudinal axis on a plane including the body longitudinal axis, and being perpendicular to the cam roller rotation axis, is greater than the third portion width value.

7. The roller tappet according to claim 6, wherein the third portion depth value is substantially equal to a depth maximum value of the roller tappet body, which is in turn substantially equal to the width maximum value of the roller tappet body.

8. The roller tappet according to claim 4, wherein a second portion depth value of the roller tappet body, measured perpendicularly to the body longitudinal axis on a plane including the body longitudinal axis, and being perpendicular to the cam roller rotation axis, is substantially equal to a depth maximum value of the roller tappet body, which is in turn substantially equal to the width maximum value of the roller tappet body.

9. The roller tappet according to claim 8, wherein a third portion depth value of the roller tappet body, measured perpendicularly to the body longitudinal axis on a plane including the body longitudinal axis, and being perpendicular to the cam roller rotation axis, is greater than the third portion width value.

10. The roller tappet according to claim 9, wherein the third portion depth value is substantially equal to the depth maximum value of the roller tappet body, which is in turn substantially equal to the width maximum value of the roller tappet body.

11. The roller tappet according to claim 4, wherein a second portion depth value of the roller tappet body, measured perpendicularly to the body longitudinal axis on a plane including the body longitudinal axis, and being perpendicular to the cam roller rotation axis, is substantially equal to the second portion width value, and wherein a third portion depth value of the roller tappet body, measured perpendicularly to the body longitudinal axis on a plane including the body longitudinal axis, and being perpendicular to the cam roller rotation axis, is substantially equal to the third portion width value.

12. The roller tappet according to claim 1, wherein the roller tappet body comprises a pump seat having a pivoting area to enable pivoting of the roller tappet body around an end of the reciprocating element of the fuel unit pump.

13. The roller tappet according to claim 12, wherein a width of the roller tappet body, measured perpendicularly to the body longitudinal axis on a plane including the body longitudinal axis, and being parallel with respect to the cam roller rotation axis, has a width maximum value at a height of said pivoting area.

14. An internal combustion engine comprising a rotatable shaft having at least one cam lobe, a fuel unit pump having a reciprocating element, and a roller tappet according to claim 1.

* * * * *